United States Patent [19]

Haberer

[11] 4,407,315

[45] Oct. 4, 1983

[54] APPARATUS FOR CLEANING INTERIOR OF A MILK TANK

[76] Inventor: Merle D. Haberer, 4057 Main St., Bowdle, S. Dak. 57428

[21] Appl. No.: 272,911

[22] Filed: Jun. 12, 1981

[51] Int. Cl.[3] ..... B08B 9/08

[52] U.S. Cl. ..... 134/58 R; 134/169 R

[58] Field of Search ..... 134/58 R, 169 R, 169 C

[56] References Cited

U.S. PATENT DOCUMENTS

| | | | |
|---|---|---|---|
| 3,033,215 | 5/1962 | Miller | 134/98 |
| 3,062,224 | 11/1962 | Skett et al. | 134/58 R |
| 3,188,238 | 6/1965 | Lyon | 134/24 |
| 3,448,742 | 6/1969 | Bender | 134/57 R |
| 3,589,378 | 6/1971 | Swanson et al. | 134/58 R |
| 3,825,022 | 7/1974 | Metz | 134/104 |
| 3,860,018 | 1/1975 | Reiter | 134/22 |

OTHER PUBLICATIONS

Bulletin C-1-225-Advertising Brochure of St. Regis CP Division Brochure Entitled "The Automatic Washer" of Sunset Supply.

Advertising Brochure of Sunset Equipment Co. Entitled "Sunset Photo Report" Brochure of Paul Mueller Company Entitled "Mueller Matic Automatic Washing System".

*Primary Examiner*—Robert L. Bleutge

*Attorney, Agent, or Firm*—Kinney, Lange, Braddock, Westman and Fairbairn

[57] ABSTRACT

A permanently mounted tank cleaning apparatus cleans interior surfaces of a bulk milk storage tank using a plurality of cleaning cycles, each cycle characterized by a separate cleaning step. The tank includes a device for dispersing fluid against the interior surfaces of the tank and an outlet proximate its bottom interior surface. A pump is fixedly associated with the dispersing device by a conduit and pumps fluid to the dispersing device through the conduit. A three-way valve assembly is fixedly attached to the outlet of the tank and is positionable in a closed position, a milk removal position, and a tank cleaning position. A solenoid drain valve is positioned between the pump and the tank cleaning position of the three-way valve and below the bottom interior surface of the tank. The tank cleaning position of the three-way valve, the drain valve and the pump are all fixedly attached to each other by conduit and fluid is conveyed from the tank to the pump and to the dispersing device in the tank in a closed loop system. An electronic control device controls the length of each cycle and the input of fluid into the tank and controls operation of the pump and the drain valve such that the pump circulates fluid during each cycle and the drain valve opens and drains the fluid at the end of each cycle.

5 Claims, 6 Drawing Figures

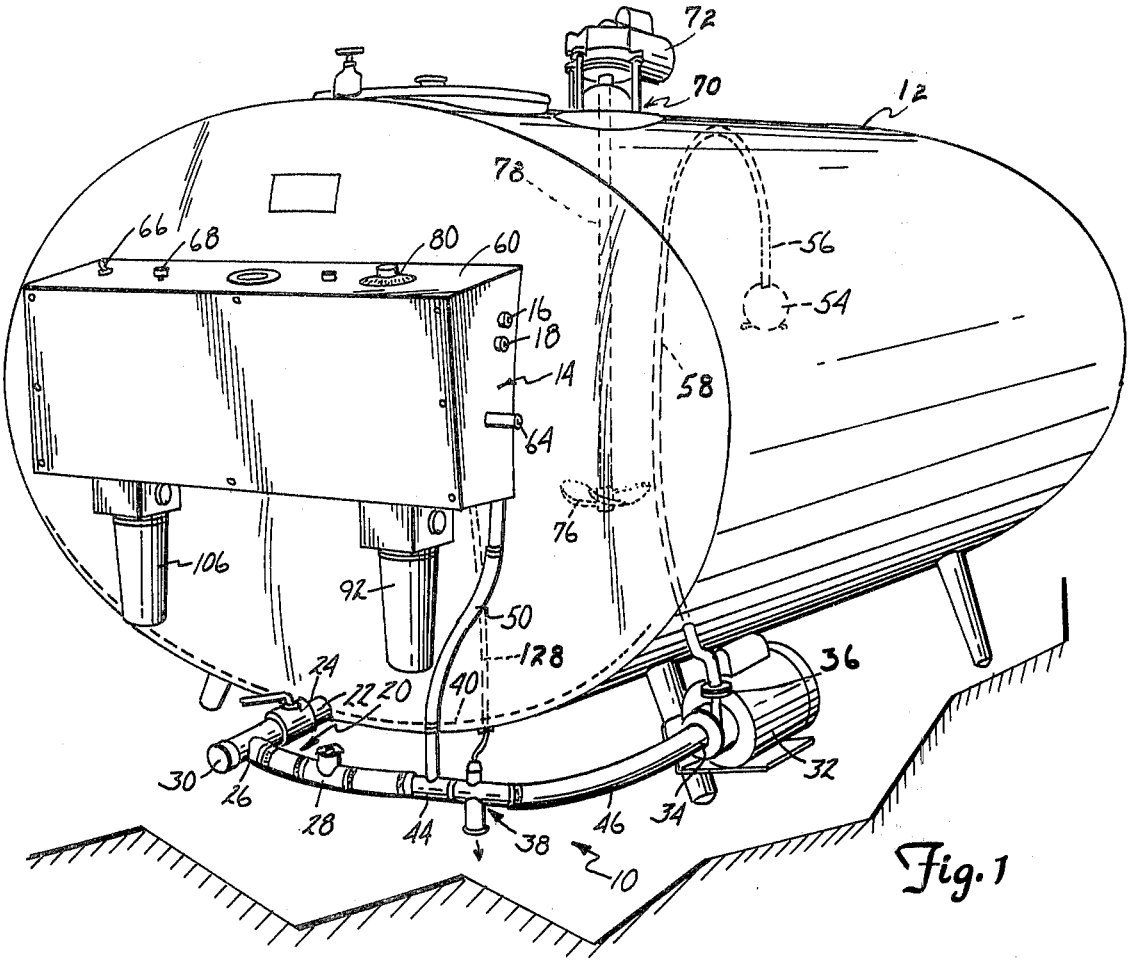
Fig. 1
Fig. 2
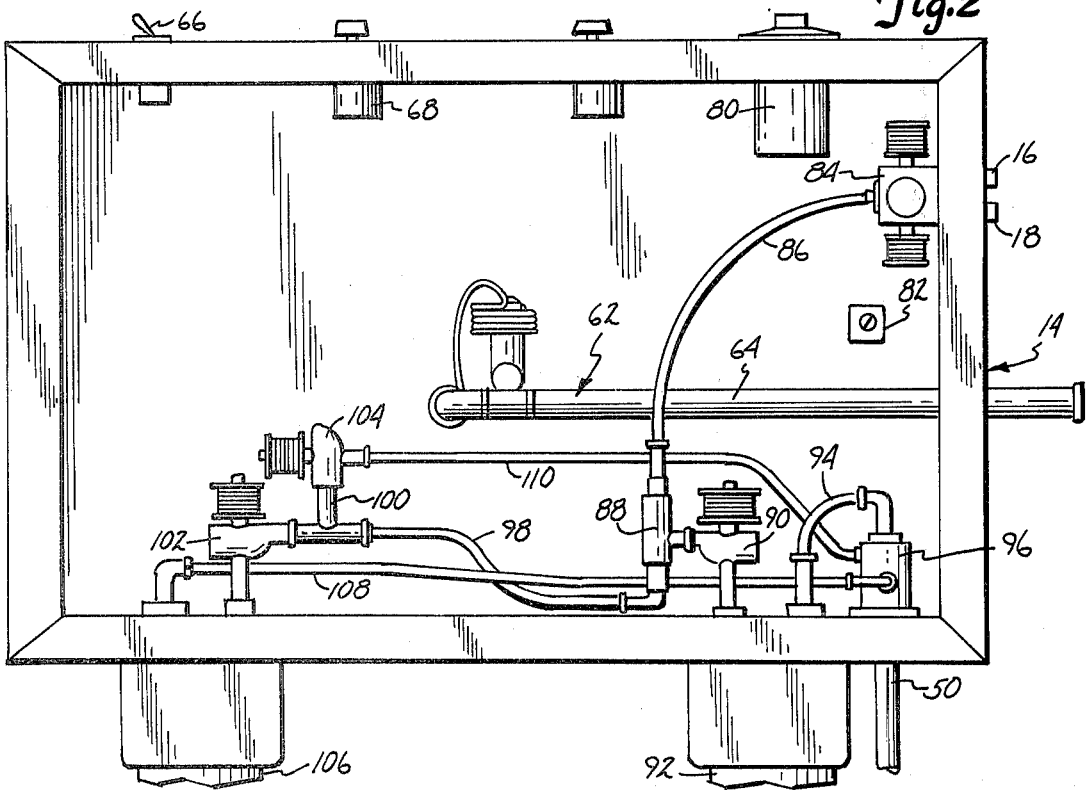

APPARATUS FOR CLEANING INTERIOR OF A MILK TANK

BACKGROUND OF THE INVENTION

1. Field of the Invention

The present invention relates to tank cleaning apparatus, and in particular, it relates to apparatus that automatically cleans the inside of a bulk milk storage tank in a sequence of automatically controlled cycles.

2. Description of the Prior Art

Milk on a dairy farm is stored in bulk cooling tanks until it is picked up for processing. The size of the tanks typically range from 300 to 3,500 gallons. The milk is picked up by the processor in a tank truck, typically, every other day or every day, depending on the size of the tank and the amount of milk being produced on the particular dairy farm. Regulations require that the interior surfaces of the storage tank be cleaned and sanitized each time the tank is emptied. Consequently, if the milk is picked up every other day, the tank must be cleaned every other day, and if the milk is picked up every day, the tank must be cleaned every day.

The cleaning of the milk storage tank is quite a chore since it requires at least three steps and sometimes four to satisfy the regulations and to insure that no stale or old milk has been left behind to contaminate the new incoming milk. The steps usually include a rinse, a detergent wash, an acid rinse, and an optional sanitizing step. A considerable amount of time is typically spent either handwashing the inside of the tank, or connecting washing equipment to the tank and monitoring the equipment during the various cycles.

There are several prior art patents which show various tank cleaning systems used for cleaning tanks on transport trucks which are of interest. They are:

Miller, U.S. Pat. No. 3,033,215, granted in May of 1962; Lyon, U.S. Pat. No. 3,188,238, granted in June of 1965; Metz, U.S. Pat. No. 3,825,022, granted in July of 1974; Reiter, U.S. Pat. No. 3,860,018, granted in January 1975

There are also several commercial devices presently on the market which clean bulk milk storage tanks in a plurality of cleaning cycles. Generally, each of the commercial systems includes a control cabinet wherein hot and cold water is mixed with an appropriate cleaning compound through a series of solenoid valves and then supplied either to a recirculating pump, or fed directly into the tank. A pump pumps the cleaning solution during each cycle through a spray nozzle that is positioned within the interior of the tank.

One such company is the Paul Mueller Company of Springfield, Mo. which manufactures a portable pump unit which has a spray nozzle which extends into the tank outlet from which milk is normally pumped. The cleaning fluid is supplied directly to the pump and sprayed within the tank. When a particular cycle ends, the tanks is drained by a diaphragm-type drain valve which operates on water pressure.

Two other commercial cleaning systems, the first manufactured by Sunset Equipment, St. Paul, Minn., and the other marketed by CP Division of St. Regis of Chicago, Ill., are also portable systems which have to be connected to the milk tank each time the milk tank has been emptied. These systems pump fluid into the interior of the tank through a spray device that is positioned proximate the top interior surface of the tank. A section of conduit is then attached to the outlet from which milk is normally emptied from the tank forming a closed loop recirculation system.

All of the above commercial cleaning systems have to be attached each time the milk tank is emptied which can occur every day or every other day. After cleaning, the systems have to be disconnected so that the milk tank is ready for the next milking. The systems of the prior art have been portable cleaning systems, since regulations in the storage and handling of milk are rather strict. The attachment and detachment of these cleaning systems increases the opportunity for contamination.

In addition, during the cleaning cycles, the fluid is normally drained on the floor of the milk house running into a floor drain. For this reason, the portable systems of the prior art also pose an electrical hazard since the electrical cords which operate the pumps and the electronic solenoid valves are typically lying on the floor.

SUMMARY OF THE INVENTION

The present invention includes a permanently mounted cleaning apparatus for cleaning interior surfaces of bulk milk storage tanks. The tank cleaning apparatus, being permanently mounted to the milk tank, permits filling of a tank with milk, storage of milk in a tank, and removal of milk from a tank without disconnection of the cleaning apparatus and without contamination of milk within the tank. The cleaning apparatus cleans the interior surfaces of the milk tank in a plurality of cleaning cycles, each cleaning cycle being a separate cleaning step.

The cleaning apparatus includes a pump which pumps fluid to a dispersing device within the tank interior which disperses the fluid against the interior surfaces of the tank. The pump pumps fluid to the dispersing device through a section of conduit and is fixedly attached thereto. A three-way valve assembly is fixedly attached to an outlet of the tank located proximate a bottom interior tank surface. The three-way valve assembly has a closed position, a milk removal position, and a tank cleaning position. A solenoid drain valve is positioned in a conduit open between the pump inlet and the tank cleaning position of the three-way valve assembly and below the bottom interior surface of a tank. This conduit conveys fluid from the bottom of the tank through the three-way valve assembly and drain valve to the pump inlet; and the pump conveys the fluid to the dispersing device within the tank, completing a closed loop recirculation system. Electronic controls control the length of each cycle and the input of fluid into the cleaning apparatus and control the operation of the pump and the drain valve such that the pump pumps fluid during each cycle and the drain valve opens, draining the fluid at the end of each cycle.

The tank cleaning apparatus operates as a completely automatic cleaning system. The pump and the conduits which circulate the various cleaning fluids used in each cycle are permanently mounted to the milk tank. Permanent mounting of the conduits and the pump eliminates the time-consuming task of connecting the cleaning apparatus to the milk tank each time the milk tank is emptied, which occurs at least every second day, and can occur every day. In addition, the dangers of electrical shock due to the electrical cords of the apparatus lying on the floor are eliminated.

BRIEF DESCRIPTION OF THE DRAWINGS

FIG. 1 is a perspective view of the cleaning apparatus of the present invention permanently attached to a bulk milk storage tank;

FIG. 2 is a front view of the interior of a control unit of the apparatus;

DETAILED DESCRIPTION OF THE PREFERRED EMBODIMENTS

Figure 3:
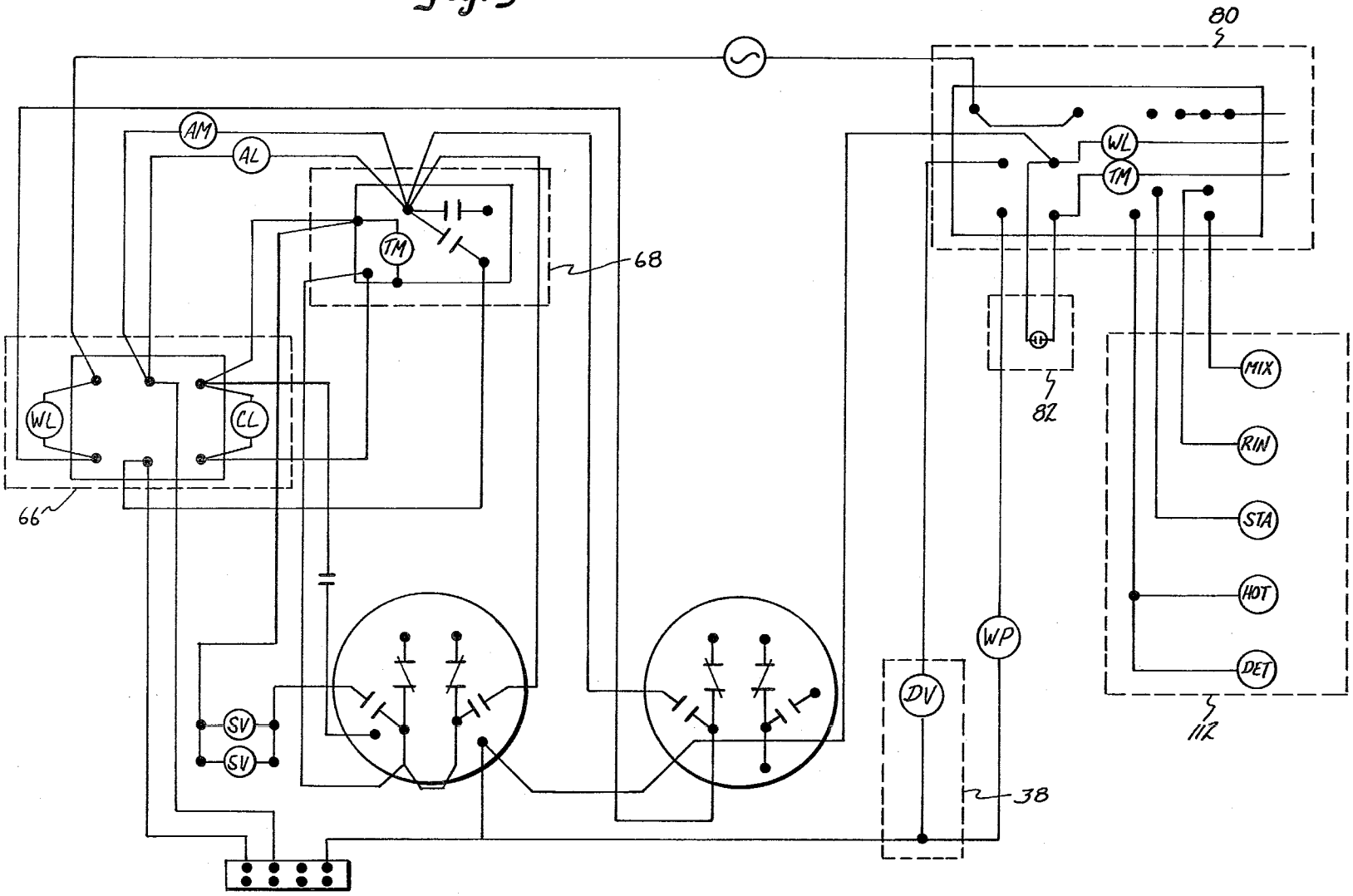
FIG. 3 is a schematic diagram of the electronic elements of the control system of the present invention.

A tank cleaning apparatus of the present invention is generally indicated at 10 in FIG. 1. Like reference characters will be used to indicate like elements throughout the various figures. The cleaning apparatus 10 is preferably mounted to a bulk milk storage tank 12. The bulk milk storage tank 12 is a conventional milk tank used in the storage of unprocessed milk obtained from cows. It includes an outer casing and an inner line spaced from the outer casing. The bulk milk tank 12 is typically located in a milk house and is connected to a vacuum conveying system which conveys the milk directly from the cows through a filter system to the milk tank.

The milk is normally removed to a transport truck at least once every two days and transported to a processing plant. Occasionally, depending upon the size of the tank and the milk output of a particular farm, the pickup may occur on an everyday basis. After the tank has been emptied of milk, regulations require that the interior of the tank be completely washed, and depending on the particular state, can include sanitation of the interior surfaces. The cleaning apparatus of the present invention is designed to provide the most efficient manner of cleaning the interior surface of the milk tank 12, allowing the farmer more time to conduct his daily chores without having to connect and stand by and monitor the cleaning apparatus through the cleaning cycles.

The cleaning apparatus 10 is permanently mounted to the bulk milk tank 12 by suitable means. The system 10 is permanently mounted in the context that it is capable of disconnection for repairs and maintenance, but is not disconnected after each washing. The cleaning apparatus 10 includes a control unit 14 preferably mounted to the end of the milk tank 12. Inlet conduits 16, 18 provide means for supplying inlet hot and cold water, respectively, to the control unit. Although not specifically shown, the inlets 16, 18 are connected to supply conduits which supply hot and cold water, respectively, to the control unit 14. A three-way valve assembly 20 is connected at one end to a milk outlet 22 from tank 12. The milk outlet 22 is normally used to remove milk from the tank 12 to the transport truck. The three-way valve assembly preferably includes a milk shutoff valve 24, a milk tank pipe tee 26, a recirculation shutoff valve 28 and a dust end cap 30. It will be understood by those skilled in the art that the three-way valve assembly also includes other conventional valves contained in the same housings which comply with regulations for the handling of milk.

A pump 32 has an inlet end 34 and an outlet end 36. The pump 32 is a conventional recirculation pump, preferably of the centrifugal type used for the conveyance of fluid. Alternatively, any other type of pump may be used which is capable of pumping a fluid consisting mostly of water.

An electronically actuated solenoid drain valve 38 is positioned in a conduit open between the three-way valve assembly 20 and the circulation pump 32. In addition, the solenoid drain valve is positioned at the lowest point of the cleaning apparatus 10. Specifically, the solenoid valve 38 is positioned below a lowest interior surface 40 of the tank 12, the three-way valve assembly 20, and the recirculation pump 32 while being spaced above a floor 42 on which the milk tank 12 rests.

A conduit section 44 connects the three-way valve assembly 20 to the solenoid drain valve 38. A conduit section 46 connects the solenoid valve 38 to the inlet 34 of the recirculation pump 32. Preferably, the conduit sections 44, 46 are sufficiently rigid to support and suspend solenoid drain valve 38 on a downward slope between them.

An intermediate supply conduit 50 conveys fluid from the control unit 14 to the conduit section 44 in this form of the invention. The intermediate supply conduit 50 is connected to the conduit section 44 by a conventional quick disconnect 52 which allows optional disconnection of the intermediate conduit 50 when the cleaning apparatus of the present invention is not in use.

A liquid dispersing device constituted as a spray nozzle 54 is fixedly suspended within the interior of the tank 23 by a conduit 56 which is attached to a top interior surface of the tank. The conduit 56 is open to the outlet of the pump 32 through a conduit section 58 which runs from the pump outlet into the tank 12, within the casing and outside the lining to the top of the tank. The cleansing fluid is supplied to the tank by the pump pumping fluid through conduit 58 into conduit 56 and into the spray nozzle 54 from which it emerges in all directions.

As will be understood by those skilled in the art, the present invention defines a permanent closed loop circulation system including the tank 12. For each cleaning cycle, a different fluid is supplied from the control unit 14 through the intermediate supply conduit 50 through conduit section 44, solenoid drain valve 38 and conduit section 46 into the inlet end 34 of the pump 32. The pump then pumps the solution through the conduits 58, 56 and spray nozzle 54. The spray nozzle 54 disperses fluid against the interior surfaces of the tank 12. From there, the fluid drains through tank outlet 22 and the three-way valve assembly 20 back to the recirculation pump 32.

Typically, the cleaning of a bulk milk tank includes at least three and sometimes four steps, depending on the cleaning regulations. The first step is normally a rinse step, wherein any residue film of milk left after the tank is emptied is rinsed away. The second step includes a solution of water containing detergent. This can be called the "wash step" wherein the detergent solution is sprayed on the interior surfaces of the tank, cleaning the interior surfaces. The third step includes spraying the interior surfaces with a weak acid solution to clean the interior surface of milk components such as butter fat and hard mineral deposits. It is known as the "acid rinse step". A fourth optional step is a "sanitation step" during which a sanitizing solution is sprayed on the interior surfaces killing microorganisms, such as bacteria, which are detrimental to the storage of milk.

To more fully explain the cleaning apparatus of the present invention, several of the components will be described in greater detail. Reference is made to FIG. 2 in which the control unit 14 is more fully illustrated. The control unit 14 controls the length and sequence of the individual cleaning cycles and mixes water with various cleaning components. The control unit 14 is enclosed within a cabinet 60 and contains both electronic control components and various mechanical elements controlled by the electronic components of the cleaning apparatus. In addition, the control cabinet preferably includes electronic controls for a cooling system generally indicated at 62. The cooling coils (not shown) of this system can be located within the walls of the tank 12. A cooling conduit 64 is connected to a compressor (not shown) which supplies coolant to the cooling system. the electronic controls within the cabinet 60 are omitted from FIG. 2 for purposes of clarity of illustration, but are schematically illustrated in FIG. 3 and will be referred to in describing the cleaning apparatus of the present invention.

The control unit 14 includes a main switch 66. The main switch 66 is a three-position switch, having an off position, a cooling position and a cleaning position. This switch 66 is in the cooling position when milk is being stored within the tank 12. When the switch 66 is in the cooling position the cooling system 62 is in its cooling mode. When the switch 66 is placed into the cleaning position, the cooling system is shut off, and the cleaning apparatus of the present invention is in an operational mode.

An agitator timer 68 controls an agitator 70 having an agitator motor 72 mounted on top of the tank 12 which turns an agitator blade 76 within the interior of the tank through the instrumentality of an agitator shaft 78. The agitator 70 is used to circulate the milk within the tank 12 during storage. The agitator blade 76 is left in operation by the controls, as illustrated in FIG. 3, when the cleaning apparatus of the present invention is operative in order to clean the agitator blade 76 and shaft 78 as well as the interior surfaces of the tank 12.

A main cycle timer 80 controls the length and sequence of the individual cleaning cycles and controls the mixing of water with various cleaning components. The cleaning cycles are preferably fifteen minutes long, but may be longer in the event the water pressure at a particular farm installation is too low, thus requiring more time to fill the closed cleaning loop system. In the event that the inlet water pressure is extremely low, an additional timer 82 is included to allow for the extra time needed to supply water to the cleaning apparatus of the present invention. The timer 82 is actuated inbetween the cycles created and controlled by the timer 80 thereby extending the time of each cycle.

The inlet water supplied through conduits 16 and 18 is mixed within a hot and cold mixer valve 84. A control port of the hot and cold mixer valve 84 is placed in an open position for a sufficient length of time to allow a previously determined quantity of fluid to enter the control unit 14. The hot and cold mixer valve is controlled by the timer 80.

The water flows from the mixer valve 84 through a conduit 86 to a first pipe tee 88. An acid and sanitizing solenoid valve 90 is connected to one end of pipe tee 88, and the water flows through the solenoid valve 90, if the valve is open, into a canister 92 which contains acid or sanitizing solution for mixing with the water. After the water is mixed, it flows out of canister 92 through the a conduit 94 and into a distributor manifold 96 which is connected to the intermediate conduit 50. The canister 92 is a conventional canister containing either an acid or a sanitizing solution, depending on the particular cycle, and is threadably attached to the bottom of the cabinet 60.

When the acid and sanitizing solenoid valve 90 is in its closed position, the water can flow through first pipe tee 88 and a conduit 98 to a second pipe tee 100. A detergent solenoid valve 102 is open to one end of the second pipe tee 100 and a rinse solenoid valve 104 is open to another end. When the rinse solenoid valve 104 is in a closed position and the detergent solenoid valve 102 is in an open position, the water will flow through the detergent solenoid valve 102 into a detergent canister 106 which contains a suitable detergent. The detergent canister 106 is similar to the acid and sanitizing canister 92 and is threadably attached to the bottom of cabinet 60. The water is mixed with the detergent and the mixture is forced through the detergent canister 106 through a conduit 108 and into the distributor manifold 96.

When the detergent solenoid valve 102 is in a closed position, and the rinse solenoid valve 104 is in an open position, the water flows through the rinse solenoid valve 104 and through a conduit 110 into the distributor manifold 96. The controls for the mixer valve 84, the solenoid valves 90, 102 and 104 are illustrated schematically in FIG. 3 as at 112. As will be understood by those skilled in the art and which will be described further below, the timer 80 controls the various combinations of closed and open positions of the valve and the length of time they are open.

Referring back to FIG. 1, the three-way valve assembly 20 is an important feature of the present invention. The three-way valve assembly 20 is positionable into three conditions. The first is a closed or milk storage condition, wherein the valves 24, 28 are in the closed position and the dust cap 30 is preferably attached to the open end of the milk tank pipe tee 26. The second condition is the milk removal condition, wherein the dust cap 30 is removed, and the valve 24 is opened with the valve 28 being closed. The third condition is the cleaning condition wherein the cleaning apparatus of the present invention is operable. In the cleaning position, valves 24 and 28 are in the open position with the dust cap 30 being attached to the end of the pipe tee. In the cleaning position, fluid from the control unit 14 which is being recirculated through the cleaning apparatus is allowed to flow from the tank through the valves 24, 28 and the conduit sections 44, 46 and the closed drain valve 38 into the inlet end of the pump 32. When the cleaning apparatus has cleaned the tank 12, the valves 24 and 28 are closed and the tank may be used to store milk. For milk removal, the dust cap 30 is simply removed and the valve 24 is opened allowing milk to flow into the transport truck (not shown) without flowing into the cleaning apparatus.

Figure 4:
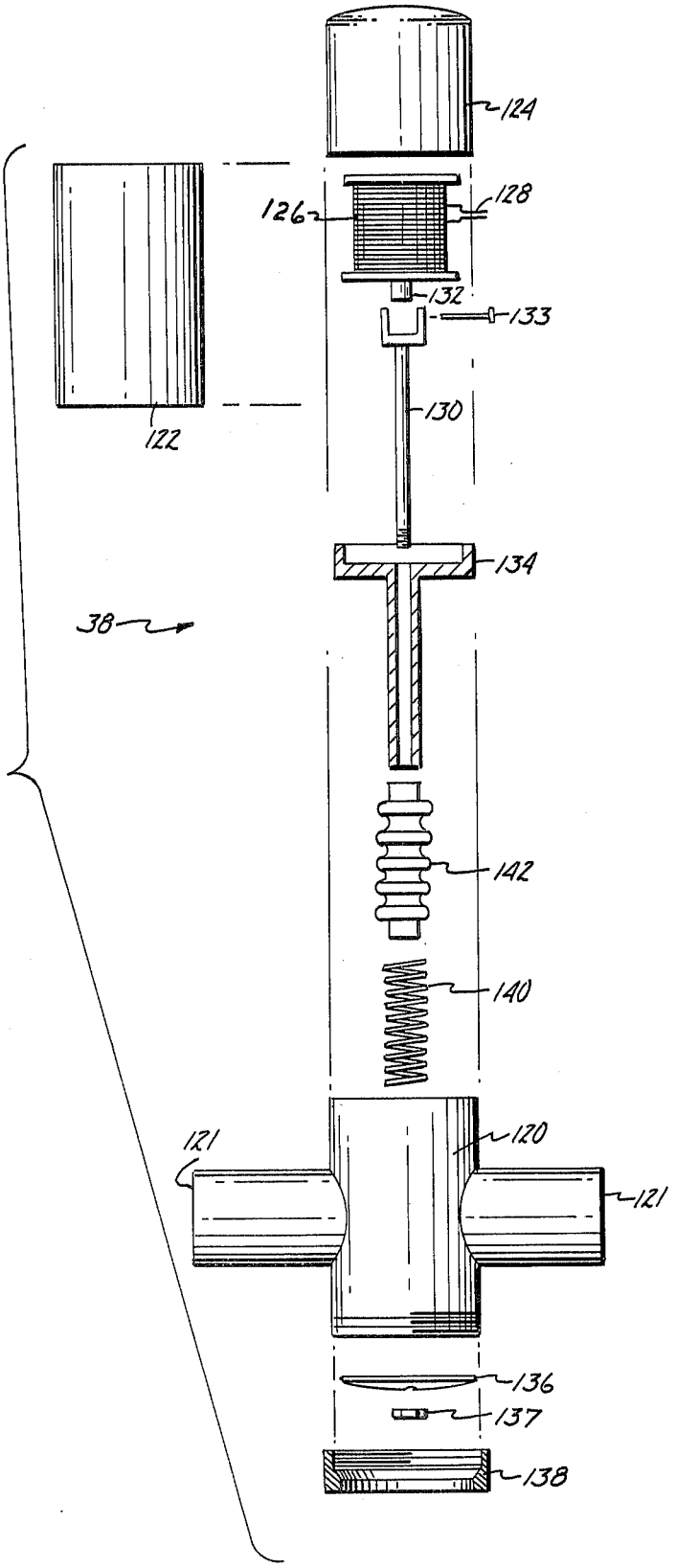
FIG. 4 is an exploded front view of a solenoid valve of the present invention.

The solenoid drain valve 38 allows the cleaning apparatus of the present invention to be drained at the end of each individual cleaning cycle. The solenoid valve 38 is an electronic solenoid valve. A preferred embodiment is more fully illustrated in FIG. 4. The solenoid valve 38 includes a main valve housing 120 with a solenoid housing 122 attached to the top thereof and a solenoid cap 124 attached to the top of the solenoid housing 122. A main housing includes a fluid channel 121 open to conduits 44 and 46 through which fluid is conveyed during each cleaning cycle. A conventional solenoid 126 is conductively connected to the control system by wires 128 which run from the solenoid valve 38 within the interior of the walls of tank 12, as illustrated in FIG. 1. A threaded plunger rod 130 is attached to a shaft 132 by a pin 133 and protrudes from the bottom of the solenoid 126. The threaded plunger rod is inserted within a waterproof guide 134 which has attached to its bottom end a plunger stopper 136. The plunger rod has a bottom threaded end which extends past the plunger stopper and threadably engages a nut 137 attaching the plunger rod 130 to the rod guide 134 and the stopper 136. The waterproof guide rod 134 extends through the housing 120 and protects the threaded plunger rod 130 from the fluids flowing through channel 121. The plunger stopper 136 is held against a plunger seat 138 by a compression coil spring 140. When the solenoid is actuated, the plunger stopper is pulled off the the plunger seat by the solenoid 126 through the threaded plunger rod 130 against the force of the spring 140, allowing fluid to flow through the plunger seat 138 to drain the cleaning system. The spring 140 is protected by an accordian-type waterproof diaphragm made of a flexible waterproof material. Although the solenoid valve 38 has been described in specific detail, other solenoid valves of usual or preferred construction are usable with the present invention.

Figure 5:
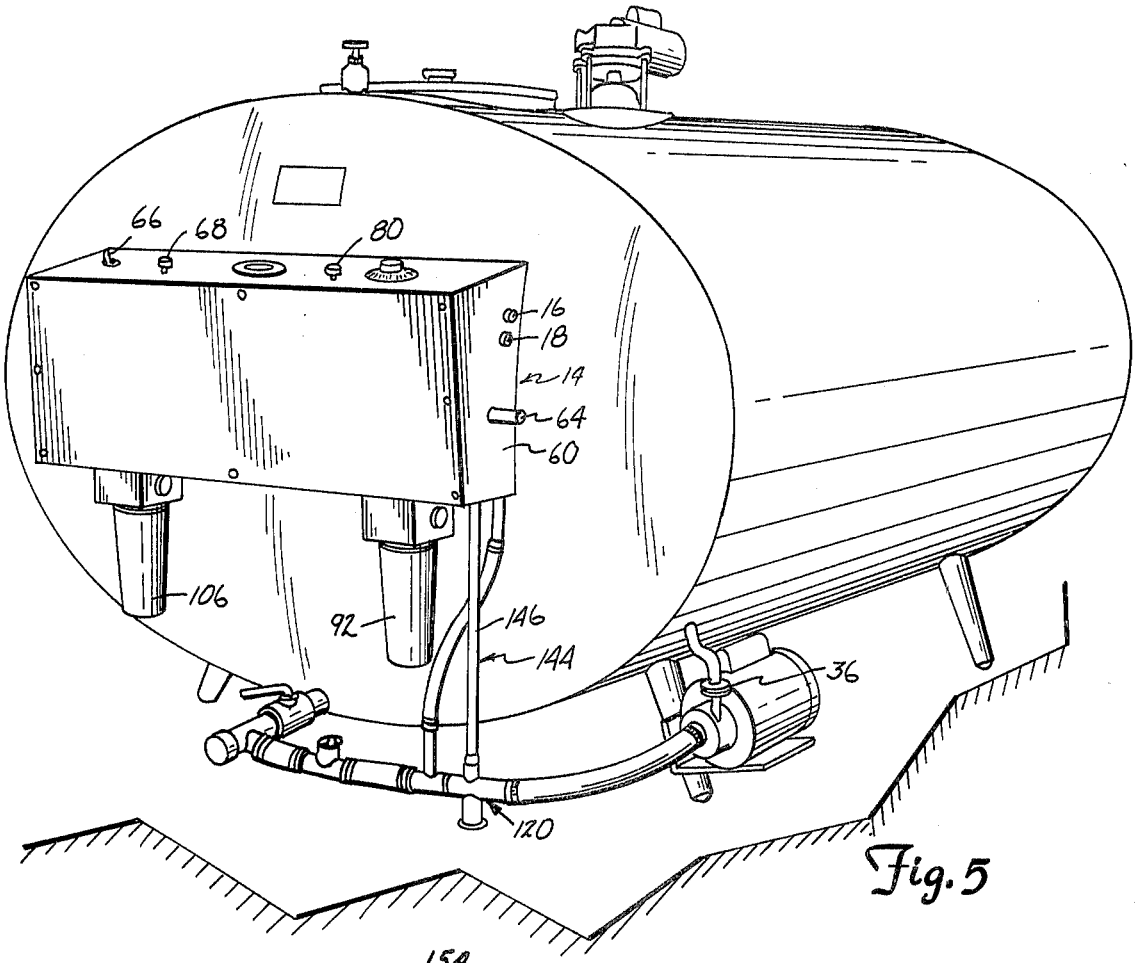
FIG. 5 is a pictorial view illustrating an alternative embodiment of the solenoid drain valve of the present invention.

An alternative embodiment of the solenoid drain valve of the present invention is generally indicated at 144 in FIG. 5. The solenoid drain valve 144 is similar in all respects to solenoid valve 38, as previously described, except the threaded plunger rod and the waterproof rod guide are considerably longer and are positioned within a conduit 146 which is attached at its lower end to the main valve housing 120 and at an upper end to the bottom of the control cabinet 60. The solenoid valve 144 is a desirable component for use in the installation of the cleaning apparatus of the present invention to an already existing milk tank wherein the installation of wires such as wires 128 within the tank walls is impractical.

Figure 6:
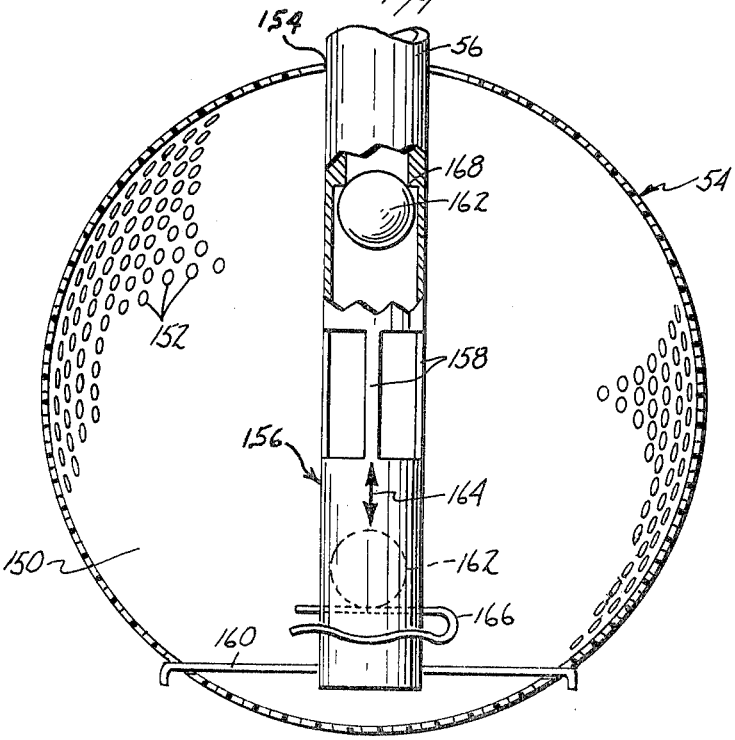
FIG. 6 is a cross-sectional view of a liquid dispensing device of the present invention with portions shown whole.

A further feature of the present invention includes the spray nozzle 54, as illustrated in FIG. 6. The spray nozzle 54 includes a main spray housing 150 of a preferred spherical configuration having a plurality of spray holes 152 strategically positioned such that fluid flowing through the spray holes 152 will reach all portions of the interior surface of the tank 12. Spray housing 150 has an upper opening 154 through which the conduit 56 extends well into the interior of the spray housing. The conduit 56 has a lower thin walled end portion 156 which is provided with a discharge opening 158. The spray housing 150 is connected to the conduit 56 by a pin 160 extending through aligned apertures of spray housing 150 and the lower end portion 156 of the conduit 56. A hollow check ball 162 floats within the lower end portion 156 as indicated by arrow 164. When the cleaning apparatus of the present invention is being operated, the hollow check ball 162, as indicated by broken lines, rests against spring clip constituted as a ball stop member 166, below the discharge opening 158, allowing fluid to flow through opening 158, within the housing 150 and through the spray holes 152. When the milk tank is filled with milk, the hollow check ball 162 floats on a surface of the milk until it reaches a seat 168 at an upper end of the lower thin walled end portion 156 of 56. When the ball 162 is forced against the seat 168, milk is prevented from flowing up the conduit 56 into the conduit 58 and into the unrefrigerated sections of the cleaning apparatus of the present invention. Prevention of the milk from flowing into the unrefrigerated sections of the cleaning apparatus eliminates the possibility of bacterial growth and contamination of the milk being delievered to the tank 12 from the cleaning apparatus.

The operation of the cleaning apparatus of the present invention is best explained by a description of the various cycles with reference to FIG. 1 and to the control unit 14 as illustrated in FIG. 2.

After the milk has been removed from the tank 12, the valve assembly 20 is placed in its cleaning condition, that is placing end cap 30 over the open end of tank tee 26 with the valves 24 and 28 in the open position. The intermediate supply conduit 50 connected to the conduit 44, and the main switch 66 are placed into the wash position. The drain valve 38 is in a closed position, and the timer 80 is activated.

In the rinse cycle, a mixture of hot and cold water at the appropriate temperature is released from the mixer valve 84. During the rinse cycle, the acid and sanitizing solenoid valve 90 and the detergent solenoid valve 102 are in the closed position while the rinse solenoid valve 104 is in the open position. Consequently, the water flows through the conduit 86, first pipe tee 88, the conduit 98, second pipe tee 100, solenoid valve 104, and conduit 110 into distributor manifold 96. In the rinse cycle, no cleaning components are added to the water, the purpose of the cycle being simply to rinse the interior of the tank of the milk film left after the removal of the milk. The timer 80 controls the length of time the mixer valve 84 is open, allowing a predetermined quantity of water to enter the cleaning system of the present invenion. In addition, the timer 80 also actuates the recirculation pump 32 so that the pump conveys the rinse water through the conduits 58 and 56 into the spray nozzle 54 such that all interior surfaces of the tank 12 are sprayed. During the rinse cycle and through the rest of the cycles, the agitator 70 is left on so that all surfaces of the blade 76 and the shaft 78 are also being cleaned simultaneously. When the rinse cycle has been completed, the timer 80 shuts off the recirculation pump 32 and activates the solenoid drain valve 38, so that the rinse water is drained from the cleaning apparatus onto the floor 42 of the milk house.

When the rinse water has been completely drained from the cleaning apparatus and the tank, the detergent cycle is started automatically by the timer 80. Similarly, a sufficient quantity of water is allowed to pass through the mixer valve 84 at an appropriate temperature as controlled by the timer 80. In the detergent cycle the acid and sanitizing solenoid valve 90 and the rinse solenoid valve 104 are in a closed position with the detergent solenoid valve 102 being open. The water flows through the detergent solenoid valve 102 into the detergent canister 106 and out through conduit 108 into the distributor manifold 96. The pump 21 is also activated by the timer 80 to circulate the detergent solution through the spray nozzle 54, as previously described. When the detergent cycle has ended, as determined by the timer 80, the drain valve 38 is again activated and drains the detergent solution onto the floor 42 of the milk house.

The acid cycle is similarly controlled by the timer 80 with the exception that the acid solenoid valve 90 is now in the open position and the rinse solenoid valve 104 and the detergent solenoid valve 102 are in the closed position. The water flows through the acid solenoid valve 90 into the acid container 92 up through the conduit 94 into the distributor manifold 96. After completion of the cycle and circulation of the solution by the pump 32, the pump is shut off and the drain valve 38 is opened, draining the system of the acid solution.

If an optional sanitizing cycle is required, the canister 92 is merely changed with a canister having a sanitizing solution at the end of the acid cycle, with the timer actuating the solenoid valves in the same combination as described in the acid cycle.

After the cleaning cycles have been completed, the tank is easily placed in condition for storage of milk without disconnecting the cleaning apparatus of the present invention. To place the tank 12 in a storage condition for milk, the valve 24 and the valve 28 are placed in a closed position with the dust cap 30 left on in case the valve 24 is accidentally opened. The intermediate supply conduit 50 can be disconnected at quick disconnect 52 to prevent accidental contamination by water and cleaning solutions which could occur if the cleaning apparatus of the present invention is accidentally turned on while milk is in the tank. During this time the agitator 70 may also be turned off until milk has been placed within tank 12.

CONCLUSION

The cleaning apparatus of the present invention with the three-way valve assembly allows permanent mounting of a cleaning apparatus to a bulk milk tank. Permanent mounting of a cleaning apparatus eliminates the time taken to connect and disconnect the cleaning apparatus each time the tank is drained of milk which occurs at least every other day. In addition, the spray nozzle with the check ball eliminates any possibility of the milk backing up the spray nozzle out of the refrigerated interior of the tank 12 thereby eliminating any hazard of bacterial growth.

Although the present invention has been described with reference to preferred embodiments, persons skilled in the art will recognize that changes may be made in form and detail without departing from the spirit and scope of the invention.

What is claimed is:

1. A tank cleaning apparatus for cleaning an interior of a milk tank in a plurality of cleaning cycles, each cycle characterizing a separate cleaning step in which a separate quantity of cleansing fluid is used, and the tank having an outlet proximate a bottom interior surface thereof, the system comprising:

three-way valve means permanently attached to the outlet of the tank, said three-way valve means being operable between a first closed condition wherein milk cannot pass out of the tank outlet, a milk removal condition whereby milk can pass out through the tank outlet and a portion of the three-way valve means to a location for use thereof, and a tank cleaning condition whereby there is a cleansing fluid opening through said three-way valve means from an interior of said tank through said tank outlet to a cleansing fluidds recirculation conduit;

means for supplying a measured quantity of the cleansing fluid to the recirculation conduit supplying the cleansing fluid to the recirculation conduit downstream of the cleansing fluid opening of the three-way valve means;

pump means having an inlet end open to said cleansing fluid recirculation conduit for receiving cleansing fluid from the means for supplying, said pump means being positioned downstream of the cleansing fluid opening of the three-way valve means;

the milk tank having means for dispersing the fluid within the interior of the tank against interior surfaces and the tank having an outlet proximate a bottom interior surface thereof, a dispersing means supply conduit open from an outlet side of said pump means to said dispersing means within the interior of said tank;

a solenoid operated drain valve in said recirculation conduit between said cleansing fluid opening of the three-way valve means and said pump means inlet, said drain valve having a drain outlet opening at a low point of said recirculation conduit and below said tank outlet, said three-way valve means and said pump means inlet; and control means operable to control the length of each cycle, the operation of said pump means and the drain valve such that the pump means recirculates the cleansing fluid during each cycle and the drain valve opens draining the fluid at the end of each cycle.

2. The apparatus of claim 1 wherein the means for dispersing the cleansing fluid includes a spray nozzle housing with a plurality of spray holes and fixedly attached to the dispersing means supply conduit within the interior of said tank and a portion of said supply conduit extending into an interior of the spray nozzle housing, said portion having a hollow interior and a cleansing fluid discharge opening, a floating check ball within the interior of the spray nozzle housing floatable to an upper portion above the discharge opening against a ball seat within the interior of said portion and to a lower position below the discharge opening against a stop member such that when cleansing fluid flows through the discharge opening, the ball floats to the lower position and when the tank is filled with milk above the ball seat, the check ball is positioned against the ball seat preventing milk from flowing into the supply conduit.

3. The apparatus of claim 1 wherein the recirculation conduit is a rigid conduit and slopes downwardly to the solenoid operated drain valve.

4. A cleansing fluid dispersing system for cleaning interior surfaces of a container for storing liquids, the container having an outlet, the system comprising:

cleansing fluid supply means for supplying a cleansing fluid;

first conduit means for conveying the cleansing fluid from the fluid supply means;

a pump positioned downstream of the fluid supply means for pumping the cleansing fluid having an inlet fluidly connected to the first conduit means and an outlet;

second conduit means for recirculating the cleansing fluid from the outlet of the container and fluidly connected to the inlet of the pump;

a third conduit means for supplying the cleansing fluid to the interior of the container and fluidly connected to the outlet of the pump;

a spray nozzle housing with a plurality of spray holes and fixedly attached to the third conduit means within an interior of the container;

a portion of said third conduit means extending with an interior of the spray nozzle housing, the portion having a hollow interior and a cleansing fluid discharge opening; and a floating check ball within the interior of said portion and floatable to an upper position above the discharge opening against a ball seat within the interior of said portion and to a lower position below the discharge opening against a stop member such that when cleansing fluid flows through the discharge opening, the ball floats to the lower position and when liquid is being stored in the container and a liquid level is above the ball seat the check ball is positioned against the ball seat preventing the liquid from flowing back into the third conduit means.

5. In combination with a bulk milk storage tank, a tank cleaning apparatus for cleaning an interior of a milk tank in a plurality of cleaning cycles, each cycle characterizing a separate cleaning step in which a separate quantity of cleansing fluid is used, and the tank having an outlet proximate a bottom interior surface thereof, the combination comprising:

three-way valve means permanently attached to the outlet of the tank, said three-way valve means being operable between a first closed condition wherein milk cannot pass out of the tank outlet, a milk removal condition whereby milk can pass out thrugh the tank outlet and a portion of the three-way valve means to a location for use thereof, and a tank cleaning condition whereby there is a cleansing fluid opening through said three-way valve means from an interior of said tank through said tank outlet to a cleansing fluid recirculation conduit;

means for supplying a measured quantity of the cleansing fluid to the recirculation conduit supplying the cleansing fluid to the recirculation conduit downstream of the cleansing fluid opening of the three-way valve means;

pump means having an inlet end open to said cleansing fluid recirculation conduit for receiving cleansing fluid from the means for supplying, said pump means being positioned downstream of the cleansing fluid opening of the three-way valve means;

means for dispersing the fluid within the interior of the tank against interior surfaces;

a dispersing means supply conduit open from an outlet side of said pump means to said dispersing means within the interior of said tank;

a solenoid operated drain valve in said recirculation conduit between said cleansing fluid opening of the three-way valve means and said pump means inlet, said drain valve having a drain outlet opening at a low point of said recirculation conduit and below said tank outlet, said three-way valve means and said pump means inlet; and control means operable to control the length of each cycle, the operation of said pump means and the drain valve such that the pump means recirculates the cleansing fluid during each cycle and the drain valve opens draining the fluid at the end of each cycle.

* * * * *